United States Patent [19]

Gage

[11] Patent Number: 4,949,802

[45] Date of Patent: Aug. 21, 1990

[54] HYDRAULIC STEERING SYSTEMS DAMPENING DEVICES

[75] Inventor: Douglas M. Gage, Dubuque, Iowa

[73] Assignee: Deere & Company, Moline, Ill.

[21] Appl. No.: 449,665

[22] Filed: Dec. 12, 1989

Related U.S. Application Data

[62] Division of Ser. No. 262,399, Oct. 25, 1988, Pat. No. 4,915,186.

[51] Int. Cl.[5] ..... B62D 5/08

[52] U.S. Cl. ..... 180/132; 180/139; 180/152; 60/413

[58] Field of Search ..... 180/132, 134, 139, 152; 60/416, 464, 466, 413, 468; 251/50; 280/492

[56] References Cited

U.S. PATENT DOCUMENTS

| | | | |
|---|---|---|---|
| 3,260,325 | 7/1966 | Brown et al. | 180/139 |
| 3,360,925 | 1/1968 | Zimmerman | 180/139 |
| 3,820,438 | 6/1974 | Kobelt | 60/413 |
| 3,872,670 | 3/1975 | Dezelan et al. | 60/413 |
| 4,097,060 | 6/1978 | Unruh | 280/492 |
| 4,310,062 | 1/1982 | Link et al. | 180/139 |
| 4,332,303 | 6/1982 | De Maight | 180/132 |
| 4,405,030 | 9/1983 | Wittren | 180/152 |

FOREIGN PATENT DOCUMENTS

| | | | |
|---|---|---|---|
| 0266785 | 5/1988 | European Pat. Off. . | |
| 56-164201 | 12/1981 | Japan | 60/416 |
| 61-139561 | 6/1986 | Japan | 180/132 |
| 0921927 | 4/1982 | U.S.S.R. | 180/132 |

*Primary Examiner*—Charles A. Marmor
*Assistant Examiner*—Anne Marie Boehler

[57] ABSTRACT

The present invention is directed to a mechanical hydraulic pressure dampening devices for use in a steering system of an articulated self-propelled work vehicle. The dampening devices are hydraulically positioned between the steering cylinders of the work vehicle and absorb hydraulic pressure spikes in the steering system. In the preferred embodiment, the pressure dampener comprises a pressure accumulator that is fluidly coupled to the steering cylinder by a shuttle check valve. The shuttle check valve shifts in response to a pressure spike so that it can be absorbed by the pressure accumulator. In a second embodiment, the pressure dampener comprises a cylinder having two pistons that are biased into a normal position by a spring extending between the pistons. Spaces are formed on either side of the pistons and are hydraulically coupled to the steering cylinders. A central space formed between the two pistons is hydraulically coupled to a sump return line. Both of the pistons are also provided with restricted orifice having check valves which permit hydraulic fluid to flow out of the central space and into the adjoining outer spaces. A third embodiment of the pressure dampener comprises a cylinder having a single piston which is biased into a normal position by two springs located on either side of the piston. Each of the spaces formed on either side of the piston are hydraulically coupled to one of the steering cylinders.

1 Claim, 4 Drawing Sheets

FIG. 1
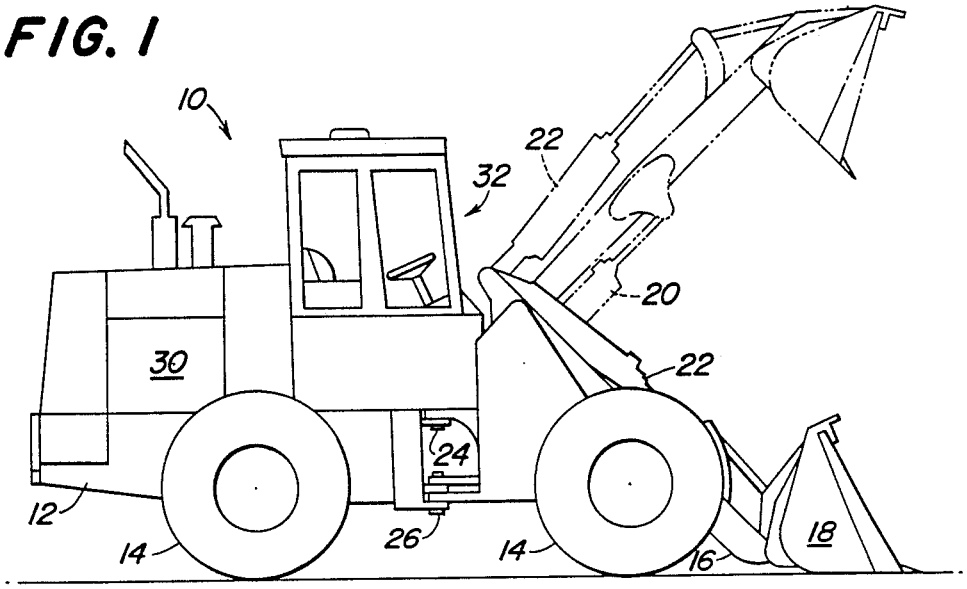
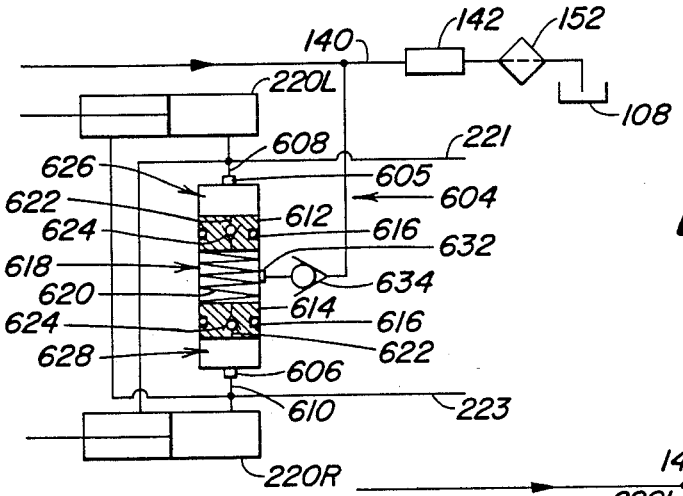
FIG. 4a
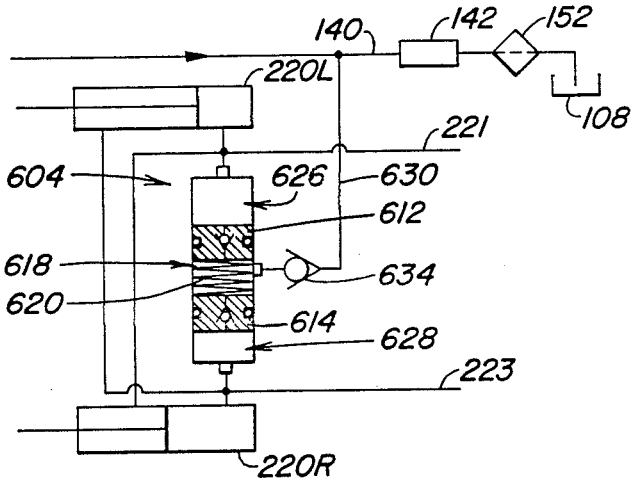
FIG. 4b

HYDRAULIC STEERING SYSTEMS DAMPENING DEVICES

This application is a division of application Ser. No. 07/262,399, filed 25 Oct. 1988, now Pat. No. 4915186, issued 10 Apr., 1990.

BACKGROUND OF THE INVENTION

1. Field of the Invention

The present invention is directed to mechanical accumulators for dampening hydraulic pressure spikes in a hydraulic steering system of a work vehicle.

2. Description of the Prior Art

Large work vehicles with hydraulic steering systems do not always steer as smoothly as desired. Current methods of overcoming this problem include using synflex hoses which are expandable to accommodate the pressure spikes, leakage systems to bleed off the pressure spikes, multiple accumulators for absorbing the pressure spikes, and cushion valves. Synflex hoses, bleed systems and cushion valves do not provide a complete solution to the problem.

SUMMARY OF THE INVENTION

In the present invention, the hydraulic output of an open center pump is directed to a priority valve for dividing the hydraulic flow between steering hydraulic circuits and working hydraulic circuits. The priority valve favors the steering circuits. A mechanical damping device is positioned between the steering hydraulic cylinders. Three dampening devices are proposed. Each of the devices is used to absorb hydraulic pressure spikes occurring in the cylinders. The most preferred of these devices comprises a single accumulator. The other two devices utilize pistons which are housed in a cylinder and which are directly coupled to a spring which is used to partially absorb the pressure spike.

In the first and preferred embodiment, a single pressure accumulator is hydraulically interconnected to the steering hydraulic cylinder by a shuttle check valve. In the second embodiment, the dampening cylinder is provided with two pistons which are operatively interconnected by a spring. Both of the pistons are provided with small restricted orifices to allow hydraulic fluid to bleed out of the space formed between the two pistons. In the third embodiment, a single piston is located in the dampening device cylinder and is provided with springs located on either side of the piston for partially absorbing the hydraulic pressure spikes.

It is the overall object of the present invention to provide devices for providing smoother steering characteristics in a work vehicle having a hydraulic steering circuit.

BRIEF DESCRIPTION OF THE DRAWINGS

FIG. 1 is a side view of a four-wheel drive articulated loader.

FIGS. 4*a* and 4*b* are cross sectional views of the second embodiment of the hydraulic dampening device.

DETAILED DESCRIPTION

Loader

Figure 2:
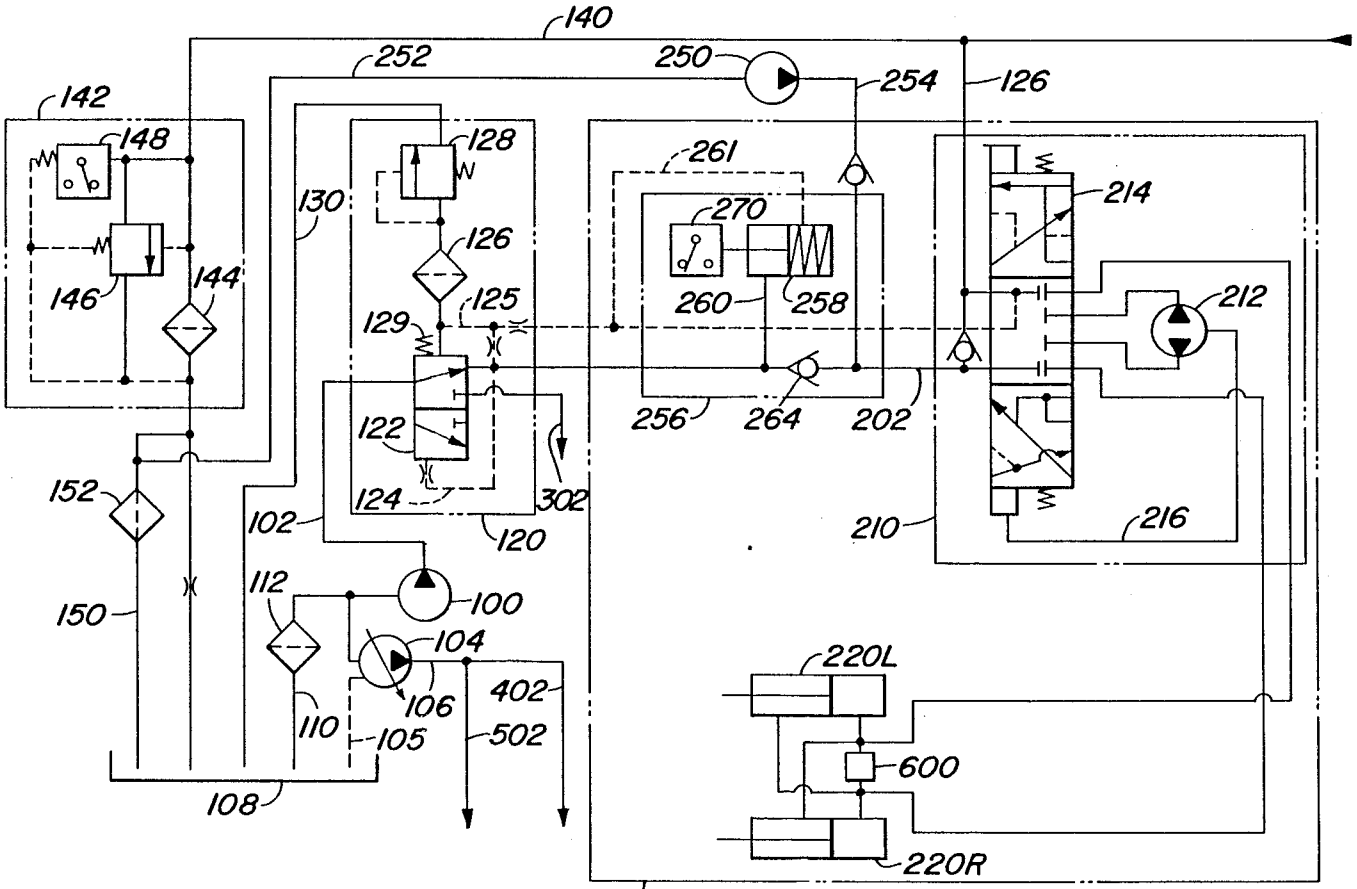
FIG. 2 is a hydraulic schematic of the steering system of the present invention.

The loader illustrated in FIG. 1 is a four-wheel drive articulated loader. Loader 10 comprises a supporting structure 12 and ground engaging wheels 14. The front of the loader is provided with a movable boom assembly 16 at the end of which is pivotally mounted bucket 18. The boom is lifted by extending boom-lift hydraulic actuator 20, and the bucket is pivoted by bucket-tilt hydraulic actuator 22.

The loader is articulated about vertical pivots 24 and 26 by a hydraulic steering circuit schematically illustrated in FIG. 2. The loader is driven by an internal combustion engine that is housed in engine compartment 30. The internal combustion engine also drives hydraulic pumps for driving the working circuits of the loader and other hydraulically actuated systems. The operator controls the operation of the loader from cab 32.

Hydraulic System

The overall hydraulic steering system is schematically illustrated in FIG. 2, comprising an open center hydraulic system and a closed center hydraulic system. The total hydraulic system for the loader is disclosed in U.S. patent application, Ser. No. 076,574, filed 11 Sept. 1987, assigned to the present assignee and incorporated herein by reference. The open center hydraulic system is provided with hydraulic fluid by fixed displacement pump 100 which pumps hydraulic fluid through hydraulic line 102. The closed center hydraulic system is provided with hydraulic fluid by variable displacement pump 104 which is provided with a pressure sensing and compensating assembly for maintaining constant pressure in hydraulic line 106. Pump 104 is also provided with drain path 105 for returning leaking hydraulic fluid back to the sump. Both pumps are operatively interconnected in a piggybacked fashion to provide a compact pumping unit. The pumps are driven by the internal combustion engine through a suitable mechanical coupling.

The pumps draw hydraulic fluid from common sump 108 through a common hydraulic fluid suction line 110. Line 110 is provided with a screen 112 for removing large particulates from the hydraulic fluid being directed to pumps 100 and 104.

The hydraulic fluid output of pump 100 is directed through line 102 to priority valve assembly 120 which prioritizes fluid flow between steering assembly 200 and the loader assembly which is fluidly coupled to line 302. The priority valve assembly gives priority to the steering assembly, shutting off hydraulic fluid flow to the loader assembly in response to fluid demands of the steering assembly. The priority valve assembly comprises a spring biased two-position spool 122 that selectively directs fluid between the steering and loader assemblies. Spool 122 is hydraulically balanced between restricted hydraulic pressure sensing lines 124 and 125. When steering valve 210 is centered in a neutral position, hydraulic flow from supply line 202 through valve 210 is stopped, increasing hydraulic pressure in line 202 and sensing line 124. In the centered position, valve 210 couples sensing line 125 to sump return line 140 through line 126 reducing hydraulic pressure in sensing line 125. As such, the increased hydraulic pressure in line 124 overcomes the hydraulic pressure in line 125 and the biasing force of spring 129 to position spool 122 so that it can transmit hydraulic fluid to loader assembly supply line 302.

The priority valve assembly is also provided with a filter 126 and pressure relief valve 128 through which hydraulic fluid can be directed to sump return line 130. The sump return line receives hydraulic fluid from sensing line 125.

Hydraulic fluid exhausted from steering assembly 200 and the loader assembly is directed by sump return line 140 to sump 108. Sump return line 140 is provided with a return filter assembly 142 having filter 144, hydraulically balanced pressure relief valve 146 and hydraulically balanced pressure sensitive electrical switchh 148. Hydraulic fluid is typically filtered by the filter and returned to sump 108. However, as the filter collects foreign material, the hydraulic pressure drop across the filter increases closing electrical switch 148. Upon the closing of electrical switch 148, an indicator light is triggered in the operator cab of the loader, alerting the operator that filter 144 should be cleaned or replaced. As the pressure drop continues to increase because of additional foreign material collected on the filter, pressure relief valve 146 opens thereby providing a hydraulic flow path that bypasses the filter.

Hydraulic fluid sump return line 150 located downstream of the filter assembly is provided with oil cooler 152 for cooling oil being returned to sump 108.

The hydraulic fluid output of pump 104 is directed to a hydraulic pressure reduction assembly through hydraulic fluid supply line 402; and a brake assembly through hydraulic fluid supply line 502.

Steering assembly 200 receives hydraulic fluid through hydraulic line 202 from priority valve assembly 120. The hydraulic fluid is directed to infinitely variable steering control valve 210. The main fluid path from the valve directs hydraulic fluid to steering hydraulic motors or cylinders 220L and 220R for assisting in steering the loader. Control valve 210 comprises fluid meter 212 and valve structure 214 which are operatively coupled to one another by mechanical follow up connection 216. Valve structure 214 comprises a main fluid path and may comprise a dampening fluid path. The dampening fluid path comprises a number of restricted passages that are used to dampen pressure spikes in the main fluid path. The steering control valve is more fully explained in U.S. patent application Ser. No. 037,493, filed 13 Apr. 1987, in which the present inventor is one of the joint inventors therein, and which is incorporated herein by reference.

The steering assembly is also provided with an optional secondary steering pump 250 which draws hydraulic fluid from sump return line 150 through hydraulic line 252 and directs the hydraulic fluid to hydraulic fluid supply line 202 by way of hydraulic line 254. The secondary pump is electrically driven and provides back up hydraulic pressure when pump 100 is not functioning. Secondary steering pump control valve 256 is used to actuate the pump. The valve comprises a hydraulically balanced spring biased piston 258 that is hydraulically balanced between sensing line 125 and supply line 202. Hydraulic sensing line 260 of control valve 256 is fluidly coupled to supply line 202 upstream of check valve 264. Hydraulic sensing line 261 of control vavle 256 is fluidly coupled to sensing line 125. The piston is coupled to electrical switch 270 which when closed actuates electrical pump 250. Switch 270 is closed when the hydraulic pressure in sensing line 125 exceeds or equals the hydraulic pressure in line 260 indicating pump 100 has failed.

Mechanical Hydraulic Pressure Dampening Devices

Figure 5A:
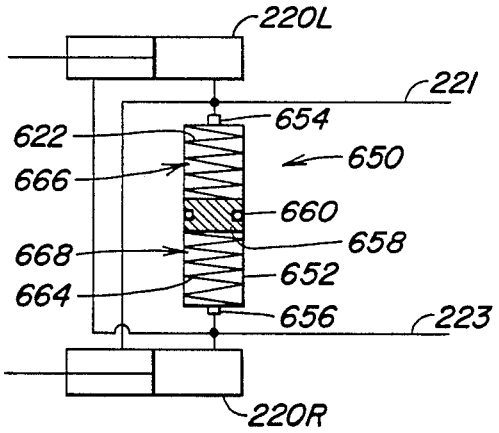
FIGS. 5*a* and 5*b* are cross sectional views of the third embodiment of the hydraulic dampening device.

Fluidly positioned between steering cylinder 220L and 220R is mechanical dampening device 600 which is the subject of the patent application. The dampening device is used to absorb and dampen hydraulic pressure spikes occurring in the steering cylinders during operation of the vehicle. These pressure spikes may be caused by rapid steering adjustment, steering reversal, and/or an external jolt to the steering system. Three embodiments of the pressure dampeners are illustrated in FIGS. 3, 4 and 5. The first dampening device embodiment 670, illustrated in FIG. 3, comprises hydraulic pressure accumulator 672 which is fluidly coupled between supply/return lines 221 and 223 of the steering cylinders by shuttle check valve 674.

Shuttle check valve 674 is provided with two inlets 676 and 678 that are fluidly coupled to steering cylinders 220L and 220R respectively. Valve 674 is also provided with outlet 680 that is fluidly coupled to hydraulic pressure accumulator 672.

Figure 3A:
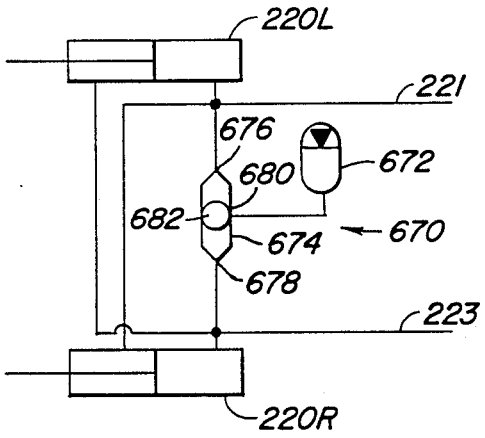
FIGS. 3*a* and 3*b* are cross sectional views of the first embodiment of the hydraulic dampening device.
Figure 3B:
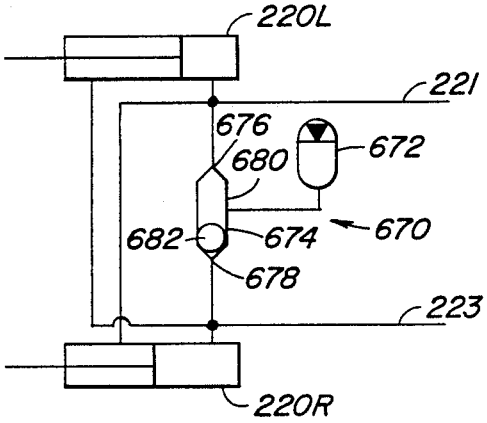

As illustrated in FIG. 3*a*, when there is no pressure differential between the steering cylinders 220L and 220R, ball 682 of shuttle check valve 674 can be located anywhere within valve 674. If one of the steering cylinders is subjected to a pressure spike, a pressure differential is created between the steering cylinders, shifting ball 682 away from the high pressure steering cylinder and towards the low pressure steering cylinder. If steering cylinder 220L is subjected to a hydraulic pressure spike, as illustrated in FIG. 3*b*, the hydraulic pressure in steering cylinder 220L is increased over the hydraulic pressure in steering cylinder 220R thereby driving ball 682 away from steering cylinder 220L and towards steering cylinder 220R.

By moving ball 682 away from steering cylinder 220L, the shuttle check valve fluidly couples steering cylinder 220L to accumulator 672. In this way, the hydraulic pressure spike is absorbed by the accumulator. Ball 682 prevents cross flow between the steering cylinders. After the hydraulic pressure spike is dissipated or removed, accumulator 672 drives hydraulic fluid back through shuttle check valve 674 to steering cylinder 220L rebalancing the steering cylinders.

In the second embodiment, illustrated in FIG. 4, dampening device 602 comprises hydraulic cylinder 604 which is fluidly coupled between supply/return lines 221 and 223. Hydraulic fittings 605 and 606 are located in the endwalls of the cylinder and couple the cylinder to the supply/return lines by hydraulic lines 608 and 610. Two pistons 612 and 614 are located within cylinder 604 and are provided with circumferential seals 616. The two pistons define three spaces within the cylinder. The first space 618 is defined between first piston 612 and second piston 614. The second space 626 is defined by first piston 612 and the endwall of the cylinder, and the third space 628 is defined by second piston 614 and its adjoining endwall of the cylinder. Spring 620 is operatively positioned between the pistons and forms a means for biasing the pistons into a normal position, as illustrated in FIG. 4*a*. In this normal position, hydraulic pressure between the steering cylinders 220L and 220R is equal. The spring acts to bias the pistons apart or outwardly from one another.

Each of the pistons is provided with a hydraulic passageway comprising a restricted orifice 622 in which is located check valve 624. Check valves 624 allow hydraulic fluid to flow from the first space 618 into the second and third spaces 626 and 628, but not from the second and third spaces into the first space. Space 618 is replenished with hydraulic fluid through hydraulic line 630 which is hydraulically coupled to sump return line 140. Line 630 is coupled to the cylinder at hydraulic fitting 632. Check valve 634 is located in line 630, allowing flow through line 630 into first space 618 and preventing flow out of space 618 through line 630.

In operation, as illustrated in FIG. 4*b*, steering cylinder 220L is subjected to a hydraulic pressure spike, increasing hydraulic pressure in second space 626. This pressure spike drives first piston 612 against spring 620 compressing the spring. Hydraulic fluid in first space 618 vents through restricted orifice 622 to steering cylinder 220R.

After the pressure spike has been absorbed by the spring and restricted orifice, spring 620 drives first piston 612 to its previous position thereby pumping hydraulic fluid back into cylinder 220L. To prevent cavitation in first space 618 as piston 612 is being returned to its normal position, hydraulic fluid is drawn from sump 108 through lines 140 and 630 past check valve 634.

It should be noted that cylinder 604 may be provided with stroke limiters to limit the movement of first and second pistons 612 and 614 within the cylinder. More specifically, internal lips may be formed in the cylinder to limit the outward movement of pistons 612 and 614 away from first space 618, thereby defining a minimum volume for second and third spaces 626 and 628. In addition, limiters may be located in the cylinder to limit the inward movement of the pistons from obstructing fitting 632, thereby preventing the flow of fluid through line 630 to space 618.

The restricted orifices may be replaced by designing a seal arrangement around each piston that serves the same function as restricted orifice 622 and check valve 624. More specifically, such a seal arrangement would permit leakage around seal 616 in only the outward direction from space 618 while preventing flow into space 618 from spaces 626 and 628.

The third embodiment of the mechanical dampening device is illustrated in FIG. 5. Pressure dampener 650 comprises a cylinder 652 having first and second hydraulic fittings 654 and 656 that are mounted to the endwalls of the cylinder. The dampener is hydraulically positioned between hydraulic supply/return lines 221 and 223. The cylinder is provided with one piston 658 having circumferential seal 660. The piston may move back and forth in the cylinder. First and second springs 662 and 664 are located on either side of the piston and tend to bias it into a centered normal position in the cylinder. Multiple springs may be used in place of first and second springs 662 and 664 to provide non-linear compression characteristics, as the springs are being compressed or extended by the movement of the piston.

Figure 5B:
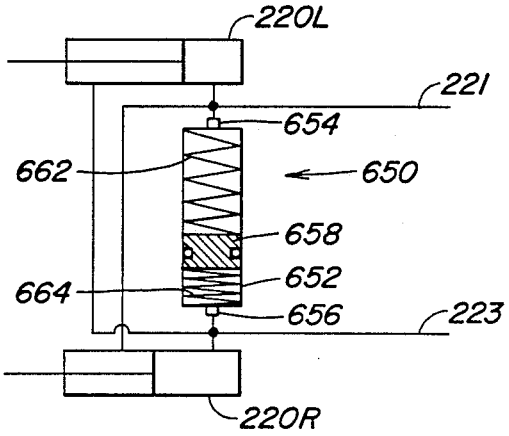

In operation, as illustrated in FIG. 5*b*, steering cylinder 220L is subjected to a hydraulic pressure spike driving hydraulic fluid through first fitting 654 from cylinder 220L and into first space 666, defined by piston 658. Piston 658 is driven downwardly compressing second spring 664 and extending first spring 662. Hydraulic fluid in second space 668, defined by piston 658, is pumped to steering cylinder 220R. After the hydraulic pressure spike has passed, first and second springs 662 and 664 recenter the piston and balance the hydraulic fluid between the steering cylinders.

The three mechanical hydraulic pressure accumulators discussed above are believed to provide a simple and effective means for dampening hydraulic pressure spikes in large vehicle steering systems. However, the invention should not be limited to the above described embodiments, but should be limited solely by the claims that follow.

I claim:

1. A self-propelled work vehicle, the vehicle having a supporting structure to which is mounted ground engaging means for propelling the vehicle, the supporting structure is also provided with a prime mover which is operatively coupled through a suitable transmission to the ground engaging means for propelling the vehicle, the vehicle comprising:

a hydraulic steering system having a source of hydraulic pressure which is directed to a steering valve, the steering valve is also provided with two steering hydraulic motors for positively turning the vehicle; and a mechanical hydraulic pressure dampening device hydraulically positioned between two steering cylinders, the pressure dampening device comprising a hydraulic pressure accumulator and a shuttle check valve having two inlets and an outlet, the outlet is hydraulically coupled to the pressure accumulator and the inlets are each adapted to be coupled to one of the two steering hydraulic motors respectively.

* * * * *